US005484108A

United States Patent [19]

Nally

[11] Patent Number: 5,484,108

[45] Date of Patent: Jan. 16, 1996

[54] FUEL INJECTOR HAVING NOVEL MULTIPLE ORIFICE DISK MEMBERS

[75] Inventor: Debora E. Nally, Williamsburg, Va.

[73] Assignee: Siemens Automotive L.P., Auburn Hills, Mich.

[21] Appl. No.: 221,193

[22] Filed: Mar. 31, 1994

[51] Int. Cl.[6] ..... F02M 51/06

[52] U.S. Cl. ..... 239/553.3; 239/585.4

[58] Field of Search ..... 239/533.12, 585.1–585.5, 239/600, 552, 553.3, 590.3, 590

[56] References Cited

U.S. PATENT DOCUMENTS

| | | | |
|---|---|---|---|
| 3,831,866 | 8/1974 | Gullaksen et al. | 239/590.3 X |
| 3,974,966 | 8/1976 | Watkins | 239/590.3 |
| 4,040,396 | 8/1977 | Tomita | 239/533.12 X |
| 4,342,552 | 8/1982 | Trippet | 239/590.2 X |
| 4,907,748 | 3/1990 | Gardner et al. | 239/590.3 X |
| 4,923,169 | 5/1990 | Grieb et al. | 239/552 X |
| 4,934,653 | 6/1990 | Grieb et al. | 239/552 X |
| 4,967,959 | 11/1990 | Wieczorek | 239/595.1 X |
| 5,063,950 | 11/1991 | Kallweit et al. | 239/553.3 X |
| 5,335,864 | 8/1994 | Romann et al. | 239/585.1 |

*Primary Examiner*—Kevin P. Weldon
*Attorney, Agent, or Firm*—Russel C. Wells

[57] ABSTRACT

Multiple stacked orifice disk members cooperatively form a chamber space through which fuel is constrained to pass as it flows from the valve seat to the nozzle. Orifices in one member that communicate the chamber space to the fuel flow are larger and perform primarily a turbulent flow creating function while orifices in another member that communicate the chamber space to the fuel flow are smaller and perform primarily a metering and targeting function. Thus, turbulence and metering functions are segregated from each other. In certain embodiments at least one more orifice disk member is sandwiched between the first two to divide the chamber space in one or more smaller chamber portions while still providing fluid communication between such portions, such added disk member(s) contributing either one or both functions of turbulence or better metering and targeting. In certain embodiments, all orifices are equal so that each contributes to turbulence, metering, and targeting.

7 Claims, 2 Drawing Sheets

FUEL INJECTOR HAVING NOVEL MULTIPLE ORIFICE DISK MEMBERS

FIELD OF THE INVENTION

This invention relates to fuel injectors of the type that inject fuel into an internal combustion engine, and in particular to novel multiple orifice disk members that improve the character of the injected fuel spray by accomplishing better fuel atomization.

BACKGROUND AND SUMMARY OF THE INVENTION

In order to improve the combustion process within combustion chamber space of an internal combustion engine for meeting certain objective criteria, especially those related to tailpipe emissions, it is generally accepted that liquid fuel should be atomized as finely as possible. Numerous and various measures have been proposed toward this end, including for example, heater attachments and air assist attachments. Such attachments naturally require additional parts, not only at the fuel injector, but also often leading to the fuel injector. Added cost and complexity are a necessary result. Strictly mechanical means in only the fuel injector itself for accomplishing improved fuel atomization would therefore seem to be a preferred solution, and the present invention relates to such a means, although it should be understood that usage of a fuel injector embodying principles of the invention could occur in conjunction with accessory devices, such as those mentioned above.

Traditionally, fuel injectors are designed to present laminar flow fluid to its metering components. Although this results in clearly defined streams exiting the fuel injector, it also results in large droplet size and poor atomization. Certain prior techniques to improve atomization have created turbulent flow upstream of the metering components, supplying angular momentum to the fuel that results in better fuel break-up at the metering components.

Prior forms of strictly mechanical means for improving fuel atomization are shown in a number of patents, including U.S. Pat. Nos. 4,628,576; 4,647,013; 4,756,508; 4,808,260; 4,826,131; 4,907,748; 4,934,653; and 5,286,002. Commonly assigned U.S. Pat. No. 4,934,653 discloses two flat orifice disk members stacked together. These orifice disk members are stainless steel and are fabricated by mechanical metalworking processes. The devices of many of the other patents comprise silicon structures, and they are typically fabricated by silicon micromachining techniques. The reader will notice that the silicon micromachined devices are integrated with the valve mechanism itself, whereas in a fuel injector, as in U.S. Pat. No. 4,934,653, the orifice disk members are non-integrated, being disposed downstream of the valve seat, just before the nozzle at which fuel is injected from the fuel injector. The fabrication of the silicon micromachined structures requires rather sophisticated, and hence costly, processing techniques and equipment. Moreover, dimensioning and tolerancing of the silicon micromachined structures is somewhat critical, but it has been recognized that certain silicon micromachined structures can provide fuel atomization that meets certain more stringent criteria, but at a disadvantage of adding to the unmetered fuel under certain engine conditions due to increased sac volume of the fuel injector. This unmetered fuel can create exhaust emission problems if not properly calibrated out. In view of the foregoing, it would therefore seem to be significantly advantageous if a fuel injector could accomplish the desired improved fuel atomization by using metal orifice disks, stainless steel disks for example, that do not increase the sac volume and that do not require the use of micromachining techniques like those required to produce the aforementioned silicon micromachined structures but rather are fabricated by metalworking techniques, such as those employed in U.S. Pat. No. 4,934,653 for fabricating orifices disks, and such advantages are present in the present invention.

Accordingly, in one comprehensive aspect the present invention may be said to relate to a fuel injector for injecting fuel into an internal combustion engine comprising a body, a fuel passageway through the body leading to a nozzle from which fuel is injected, a valve seat circumscribing an opening and disposed internally of the body within the passageway, an electrically operated mechanism comprising a valve element that is reciprocated relative to the valve seat to close and open the passageway to flow by seating and unseating the valve element on and from the valve seat to close and open the circumscribed opening through the valve seat, and orifice disk means disposed in the passageway between the valve seat and the nozzle, characterized in that said orifice disk means comprises two orifice disk members stacked face-to-face to mutually abut around their perimeters but are shaped in their central regions to cooperatively define between themselves a walled chamber space, each orifice disk member comprises at least one through-orifice extending through the wall of the chamber space to place the chamber space in fluid communication with the fuel passageway so that fuel that has passed through the valve seat opening passes through the chamber space before it is injected from the nozzle, and collectively the orifices perform turbulence-creating, metering, and targeting functions, although any particular orifice may perform primarily only one of these functions or a combination of two or more of these functions.

Within this comprehensive aspect, the fuel injector is characterized further: in that in certain species of the invention the at least one through-orifice in the one orifice disk member comprises plural such through-orifices, and the at least one through-orifice in the other orifice disk member comprises plural such through-orifices, and further in that each one of the through-orifices in the one orifice disk member has a larger flow area than each one of the through-orifices in the other orifice disk member; in that in certain species of the invention the at least one through-orifice in one of the orifice disk members has a larger flow area than the at least one through-orifice in the other of the orifice disk members, and further in that in some of these species said one orifice disk member is upstream of the other while in other of these species said other orifice disk member is upstream of said one orifice disk member; in that in certain species of the invention the central region of a particular orifice disk member is fiat while the central region of the other orifice disk member is not fiat, and further in that in some of these species of the invention, the orifice disk member whose central region is fiat is disposed upstream of the other orifice disk member while in other of these species, it is disposed downstream; in that in certain species of the invention a third orifice disk member is disposed sandwiched between the one and the other orifice disk members to divide the chamber space into two portions and comprises its own at least one through-orifice for placing the two portions of the chamber space in fluid communication with each other; in that in certain species of the invention the at least one through-orifice in one of the orifice disk members is organized and arranged to create primarily turbulent flow, and the at least one through-orifice in the other of the orifice disk members primarily meters the flow, and further in that in some of these species it is the upstream disk that primarily meters the flow and the downstream disk that primarily creates turbulence flow while in other of these species it is the downstream disk that primarily meters the flow and the upstream disk primarily creates turbulent flow. Targeting of the injected fuel toward a target that is spaced from the fuel injector's nozzle is accomplished primarily be the most downstream disk, but it is possible for an upstream disk to have some influence on targeting depending on specific disk and orifice configurations. The foregoing, and further aspects, features, and advantages, may be seen in the following detailed description of a presently preferred embodiment of the invention that is accompanied by drawings illustrating the best mode contemplated at this time for carrying out the invention.

DESCRIPTION OF THE PREFERRED EMBODIMENT

Figure 1:
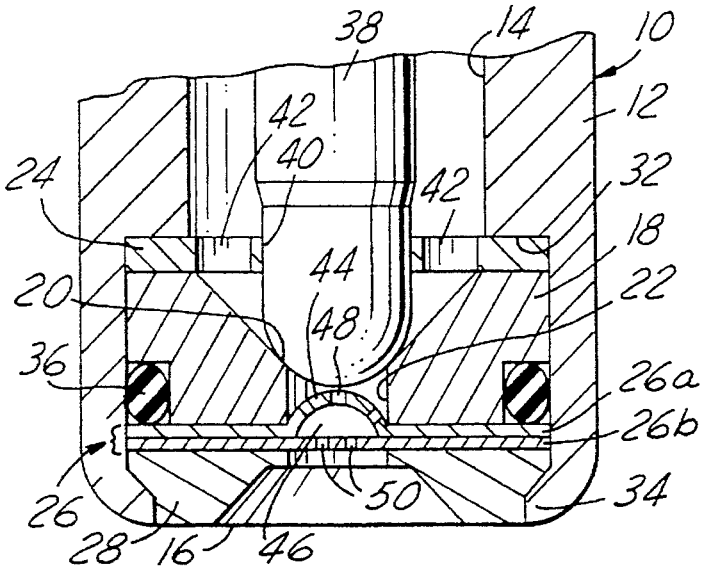
FIG. 1 is a fragmentary longitudinal cross section view proximate the nozzle of a fuel injector disclosing a first embodiment of orifice disk means.

A fuel injector 10 comprises a body 12 containing a fuel passageway 14 that extends to a nozzle 16 from which fuel is injected. An annular valve seat member 18 is disposed internally of body 12 within passageway 14 and comprises a valve seat 20 of frustoconical taper that narrows in the direction of fuel flow to a central circular hole 22. The end of body 12 proximate nozzle 16 is constructed to receive and hold in assembly relationship along with valve seat member 18, a needle guide member 24, orifice disk means 26, and an annular back-up member 28, as shown. Items 24, 18, 26, and 28 may thus be considered as forming a stack that is securely held between an internal shoulder 32 of body 12 and a crimp 34 that is created after the stack has been inserted into the body, as shown. The stack includes means, such as the illustrated O-ring seal 36 or a non-illustrated metal-to-metal seal, for establishing fluid-tightness of the perimeter of seat member 18 to the surrounding wall surface of body 12 so that fuel in passageway 14 is prevented from escaping by intruding through the clearance space between them. A needle 38 has a rounded tip end that is shown seated on seat 20 closing hole 22. Needle guide member 24 comprises a central circular through-hole 40 for guiding axial reciprocal motion of needle 38 and several other through-holes 42 that enable fuel to pass through the needle guide member. Needle 38 is axially reciprocated by means of a conventional electrically operated actuating mechanism (not shown) that typically comprises a solenoid, armature, and a bias spring. When the solenoid is electrically energized, it attracts the armature, increasingly compressing the bias spring, and unseating the needle from the valve seat in the process, thereby opening passageway 14 to fuel flow. When the solenoid is not energized, the spring forces the needle against the seat, thereby closing the passageway to fuel flow.

Orifice disk means 26 comprises a first orifice disk **26*a* and a second orifice disk 26*b*. Each is fabricated from a suitable metal, stainless steel for example, using metalworking techniques that are employed in the fabrication of orifice disks. Advantageously, these techniques can be other than the micromachining techniques used in silicon fabrication, being for example, mechanical stamping, punching, and coining. Laser machining techniques could also be used on metals like stainless steel. Disk 26*b* is completely flat; disk 26*a* however is not, being flat only at its outer margin where it abuts a corresponding outer margin of disk 26*b*. The central region of disk 26*a* comprises a dome 44 so that the two disks cooperatively form a somewhat hemispherical walled chamber space 46 between them. Dome 44 comprises several through-orifices 48 while the central region of disk 26*b* also comprises several through-orifices 50. These through-orifices 48, 50 place chamber space 46 in fluid communication with passageway 14 so that fuel is constrained to pass through chamber space 46 as it flows from the valve seat toward nozzle 16**.

Orifices 48 are intended to primarily perform a function that is different from the primary function performed by orifices 50. By making the flow area through each of the former orifices larger than that through each of the latter, the former will function to primarily create turbulent flow, while the latter will primarily meter and target the flow. Hence, each disk member may be generally said to perform a function that is different from that performed by the other.

Figure 2:
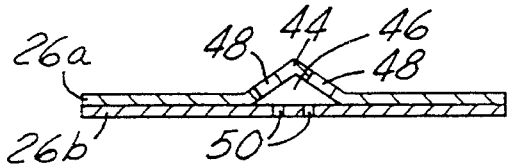
FIG. 2 is a view representative of a second embodiment.

The embodiment of FIG. 2 shows a different shaped chamber space 46 because of the different shape of dome 44 in the central portion of disk member **26*a***.

Figure 3:
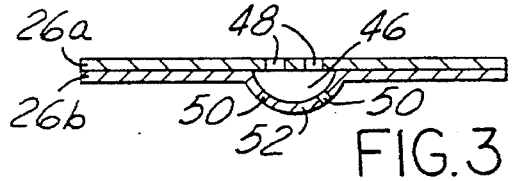
FIG. 3 is a view representative of a third embodiment.

The embodiment of FIG. 3 shows a completely flat disk member **26*a* while the central region of member 26*b* has a hemispherical dome 52**.

Figure 4:
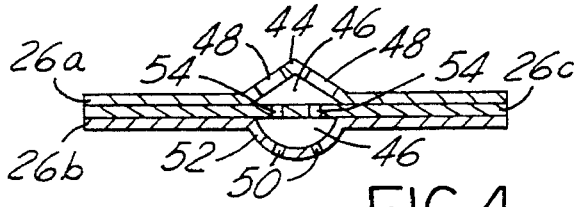
FIG. 4 is a view representative of a fourth embodiment.
Figure 5:
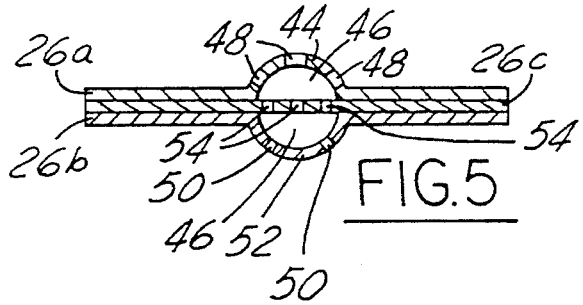
FIG. 5 is a view representative of a fifth embodiment.

The embodiments of FIGS. 4 and 5 show orifice disk means comprising a third orifice disk member **26*c* sandwiched between the members 26*a*, 26*b*. In both FIGS. 4 and 5, member 26*c* is completely flat, but comprises orifices 54 in the portion thereof that divides chamber space 46 in two. Moreover, the central regions of both disks 26*a*, 26*b* comprise domes 44, 52**.

Figure 6:
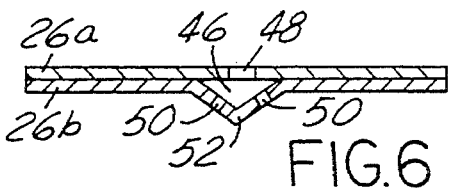
FIG. 6 is a view representative of a sixth embodiment.

FIG. 6 shows an embodiment that is like that of FIG. 2 turned upside down.

Figure 7:
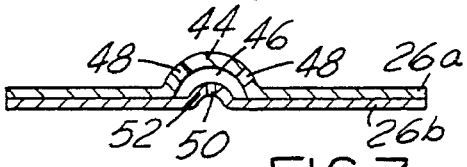
FIG. 7 is a view representative of a seventh embodiment.

FIG. 7 shows an embodiment where a smaller dome in the lower disk is nested within a larger dome in the upper disk.

Figure 8:
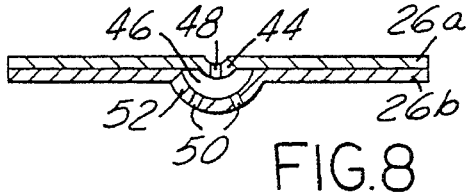
FIG. 8 is a view representative of an eighth embodiment.

FIG. 8 is like FIG. 7 turned upside down.

Figure 9:
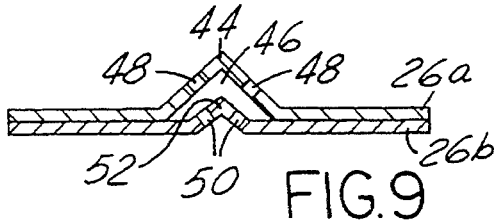
FIG. 9 is a view representative of a ninth embodiment.

FIG. 9 is like FIG. 7, but the domes are chisel-points rather than rounded domes.

Figure 10:
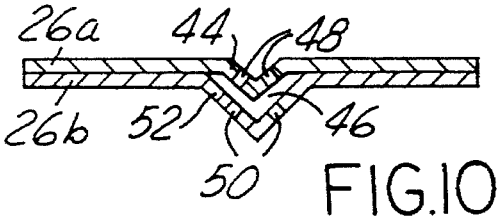
FIG. 10 is a view representative of a tenth embodiment.

FIG. 10 is like FIG. 9 turned upside down.

Figure 11:
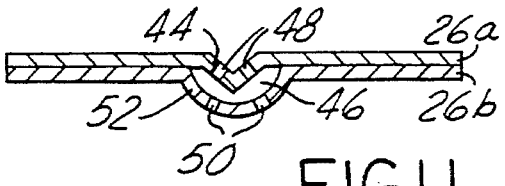
FIG. 11 is a view representative of an eleventh embodiment.

FIG. 11 shows an embodiment where a smaller chisel-point dome in the upper disk is nested within a larger rounded dome in the lower disk.

Figure 12:
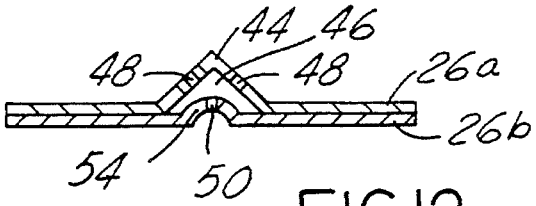
FIG. 12 is a view representative of a twelfth embodiment.

FIG. 12 is like FIG. 7, but with the upper disk's dome being a chisel-point, rather than rounded.

Figure 13:
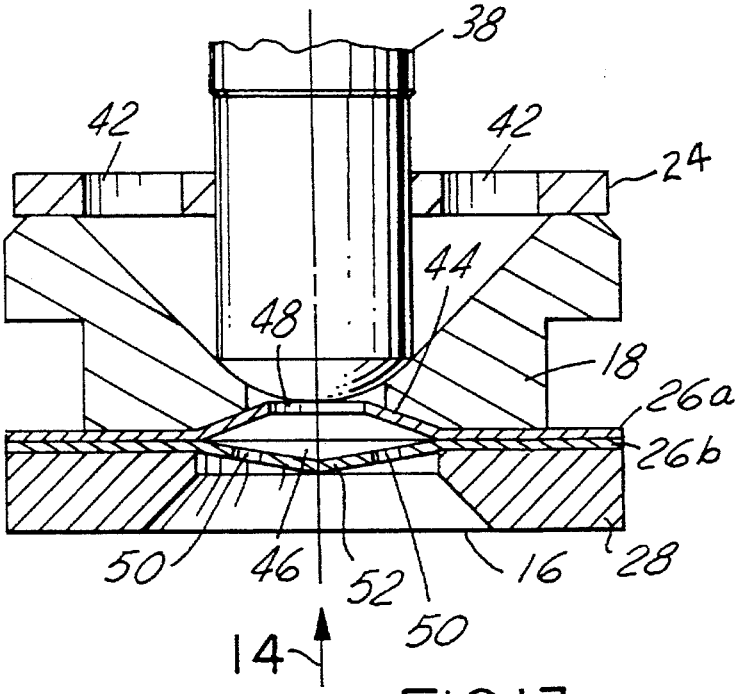
FIG. 13 is a view similar to FIG. 1 representative of a thirteenth embodiment.
Figure 14:
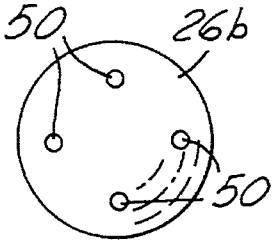
FIG. 14 is an end view in the direction of arrow 14 in FIG. 13.

The embodiment of FIGS. 13–14 comprises a somewhat frustoconical shaped dome in the upper disk and a conical-shaped dimple for the lower disk's dome. There are four orifices ninety degrees apart in the conical dimple.

It is possible that in any of the various embodiments the flow area of each of the orifices 50 may be made larger than that of each of the orifices 48 whereby the metering function will be performed primarily by orifices 48 and orifices 50 primarily perform the turbulent flow and targeting functions, or alternatively, the flow areas of the orifices in one disk may be equal to the flow areas of the orifices in the other disk. Various other patterns of orifices are contemplated within the generic aspect of the invention.

While a presently preferred embodiment of the invention has been illustrated and described, it should be appreciated that principles of the invention are applicable to all embodiments that fall within the scope of the following claims.

What is claimed as the invention is:

1. A fuel injector for injecting fuel into an internal combustion engine comprising:

a body, a fuel passageway through said body leading to a nozzle from which fuel is injected, a valve seat disposed internally of said body within said passageway, a valve element that is reciprocated relative to said valve seat to close and open said passageway to flow by seating and unseating said valve element on and from said valve seat, and at least two thin disk orifice members disposed in said passageway between said valve seat and said nozzle, said thin disk orifice members being fabricated from a metallic material are stacked face-to-face to abut around their perimeters at least one of which is shaped in its central region to cooperatively define between themselves a walled chamber space, one of said orifice disk members comprises a plurality of through-orifices extending into said chamber space to place said chamber space in fluid communication with said fuel passageway and the other of said orifice disk members having a plurality of through-orifices extending into said chamber space to place said chamber space in fluid communication with said nozzle, each one of said through-orifices in said one orifice disk member has a larger flow area than each one of said through-orifices in said other orifice disk member: so that fuel that has passed through said valve seat passes through said chamber space before it is ejected from said nozzle.

2. A fuel injector as set forth in claim 1 wherein said central region of one of said orifice disk members is flat while said central region of the other said orifice disk member is non-flat.

3. A fuel injector as set forth in claim 1 wherein said central regions of both of said orifice disk members are non-flat.

4. A fuel injector as set forth in claim 3 wherein said central regions of said orifice disk members comprise respective domes that project away from each other.

5. A fuel injector as set forth in claim 3 wherein said central regions of said orifice disk members comprise respective domes wherein one of said domes is nested within the other.

6. A fuel injector as set forth in claim 1 additionally including a third orifice disk member is sandwiched between said two orifice disk members to divide said chamber space into two portions and comprises its own at least one through-orifice for placing the two portions of said chamber space in fluid communication with each other.

7. A fluid injector having an input port and an output port, a passageway from the input port to the output port, and a valve element intermediate the input port and the output port for opening and closing the passageway, the improvement comprising:

two orifice disk members fabricated from a metallic material and located between the valve element and the output port, said members stacked face-to-face to abut around their perimeters but are shaped in their central regions to cooperatively define between themselves a chamber, one of said orifice disk members comprises at least one orifice extending into said chamber for fluid communication with the passageway and the other of said orifice disk members having at least one orifice extending into said chamber for fluid communication with the output port so that fluid that has passed through the valve element passes through said chamber before it is ejected from the output port: and a third orifice disk member is sandwiched between said two orifice disk members to divide said chamber space into two portions and comprises its own at least one through-orifice for placing the two portions of said chamber space in fluid communication with each other.

* * * * *